US008209881B2

(12) United States Patent
Lee

(10) Patent No.: US 8,209,881 B2
(45) Date of Patent: Jul. 3, 2012

(54) CONDENSATION TYPE DRYER

(75) Inventor: Ju Dong Lee, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 451 days.

(21) Appl. No.: 12/489,532

(22) Filed: Jun. 23, 2009

(65) Prior Publication Data

US 2009/0320311 A1 Dec. 31, 2009

(30) Foreign Application Priority Data

Jun. 27, 2008 (KR) ..... 10-2008-0061340

(51) Int. Cl.
*F26B 11/00* (2006.01)

(52) U.S. Cl. ..... 34/595; 34/606; 34/610; 68/20; 68/24; 165/10

(58) Field of Classification Search ..... 34/73, 82, 34/595, 601, 606, 610, 90; 68/20, 24; 165/10
See application file for complete search history.

(56) References Cited

U.S. PATENT DOCUMENTS

| | | | | |
|---|---|---|---|---|
| 1,815,306 | A * | 7/1931 | Lawrence | 96/284 |
| 2,686,372 | A * | 8/1954 | Graham | 34/75 |
| 3,805,404 | A * | 4/1974 | Gould | 34/75 |
| 3,931,683 | A * | 1/1976 | Crites et al. | 34/169 |
| 4,689,896 | A * | 9/1987 | Narang | 34/82 |
| 5,186,242 | A * | 2/1993 | Adachi et al. | 165/110 |
| 7,197,838 | B2 * | 4/2007 | Jo | 34/76 |
| 2006/0179896 | A1 * | 8/2006 | Lim et al. | 68/20 |
| 2009/0320311 | A1 * | 12/2009 | Lee | 34/73 |

FOREIGN PATENT DOCUMENTS

| | | | |
|---|---|---|---|
| EP | 1391550 | A1 * | 2/2004 |
| JP | 02302299 | A * | 12/1990 |
| WO | WO 03057968 | A1 * | 7/2003 |

* cited by examiner

*Primary Examiner* — Stephen M. Gravini
(74) *Attorney, Agent, or Firm* — Schmeiser, Olsen & Watts, LLP

(57) ABSTRACT

Disclosed herein is a condensation type dryer. The dryer includes a circulation tube communicating at both ends thereof with a tub to define a passage through which air inside the tub is circulated, a blowing fan disposed inside the circulation tube to circulate the air inside the tub, a heater disposed inside the circulation tube to heat air supplied into the tub, and a condensation tube connected to a water supply source to supply cooling water into the circulation tube, the condensation tube has a serpentine shape.

6 Claims, 4 Drawing Sheets

CONDENSATION TYPE DRYER

CROSS-REFERENCE TO RELATED APPLICATIONS

The present application claims priority to Korean patent application number 10-2008-0061340, filed on Jun. 27, 2008, which is incorporated by reference in its entirety.

BACKGROUND OF THE INVENTION

1. Field of the Invention

The present invention relates to a condensation type dryer and, more particularly, to a condensation type dryer that has an enlarged contact area between cooling water and airflow in a circulation tube to enhance drying efficiency.

2. Description of the Related Art

Generally, a drum washing machine washes, dehydrates, and dries laundry through a washing cycle, a spinning cycle, and a drying cycle.

FIG. 1 is a sectional view of a conventional drum washing machine.

Referring to FIG. 1, a drum washing machine 10 includes a cabinet 11 having an opening, a tub 13 disposed inside the cabinet 11 to receive wash water, and a drum 15 rotatably disposed inside the tub 13 and receiving laundry. The tub 13 is provided with a drive unit 17, which is connected to the drum 15 to rotate the drum 15.

A water supply device 18 is connected to a water supply source outside the cabinet 11 to supply wash water to the tub 13. A drainage device 19 communicates with the tub 13 to discharge the wash water from the tub 13 to the outside.

A dryer 20 separates moisture from air circulating inside and outside the tub 13 and changes the air into a high temperature/dry state during a drying cycle. The dryer 20 includes a circulation tube 22 extending from a lower end of the tub 13 to the opening, a blowing fan 24 provided to the circulation tube 22 to generate an airflow, a heater 26 provided to the circulation tube 22 to heat air introduced into the tub 13 by the blowing fan 24, and a water supply tube 28 communicating with the circulation tube 22 and spraying cooling water to air discharged outside the tub 13 to collect moisture from the air.

When the drying cycle is started, air inside the tub 13 is circulated along the circulation tube 22 by the blowing fan 24. Here, the air circulating in the circulation tube 22 is heated into a high temperature/dry state by the heater 26 and is then supplied into the tub 13. Then, the heated air absorbs moisture from the laundry inside the tub 13 and is discharged outside the tub 13. The discharged air contacts the cooling water sprayed from the water supply tube 28 while circulating along the circulation tube 22, so that moisture in the air is condensed and separated from the air. While repeating such operation, moisture remaining in the laundry can be discharged outside the tub 13.

Since the dryer of the conventional washing machine has a narrow contact area between air circulating in the circulation tube and cooling water supplied into the circulation tube, the condensation process is inefficient and the drying operation of the dryer must be performed for a long time. Further, during the drying operation of the dryer, some of the cooling water supplied into the circulation tube tends to flow into a blowing fan, thereby causing malfunction of the blowing fan.

Therefore, there is a need to solve such problems.

SUMMARY OF THE INVENTION

The present invention is conceived to solve the problems as described above, and an aspect of the present invention is to provide a condensation type dryer that has an enlarged contact area between cooling water and airflow in a circulation tube to enhance drying efficiency and can prevent the cooling water from flowing into a blowing fan.

In accordance with one aspect of the present invention, a condensation type dryer includes a circulation tube communicating at both ends thereof with a tub to define a passage through which air inside the tub is circulated; a blowing fan disposed inside the circulation tube to circulate the air inside the tub; a heater disposed inside the circulation tube to heat air supplied into the tub; and a condensation tube connected to a water supply source to supply cooling water into the circulation tube, the condensation tube having a serpentine shape.

The circulation tube may communicate at one end thereof with a rear side lower end of the tub and may extend upward and frontward from the rear side lower end of the tub to communicate at the other end thereof with a front side upper end of the tube.

The condensation tube has the serpentine shape in a vertical direction to enlarge a contact area with air circulating in the circulation tube.

The condensation tube may be provided with a nozzle which sprays the cooling water.

The nozzle may include a plurality of nozzles arranged at predetermined intervals on a lower end of the condensation tube.

The condensation tube may be provided with cooling fins which prevent the cooling water from scattering.

The cooling fins may be arranged parallel to an airflow direction in the circulation tube.

The condensation tube may be formed with an extension part which communicates with the condensation tube and prevents the cooling water from scattering.

The extension part may extend from an outer peripheral surface of the condensation tube to be parallel to the airflow direction in the circulation tube.

BRIEF DESCRIPTION OF THE DRAWINGS

The above and other aspects, features, and advantages of the present invention will become apparent from the following detailed description in conjunction with the accompanying drawings, in which.

DETAILED DESCRIPTION OF THE INVENTION

Hereinafter, exemplary embodiments of the present invention will be described in detail with reference to the accompanying drawings. It should be noted that the drawings are not to precise scale and may be exaggerated in thickness of lines or size of components for descriptive convenience and clarity. Furthermore, the terms used herein are defined by taking functions of the present invention into account and can be changed according to the custom or intention of users or operators. Therefore, definition of the terms should be made according to the overall disclosures set forth herein.

Figure 1:
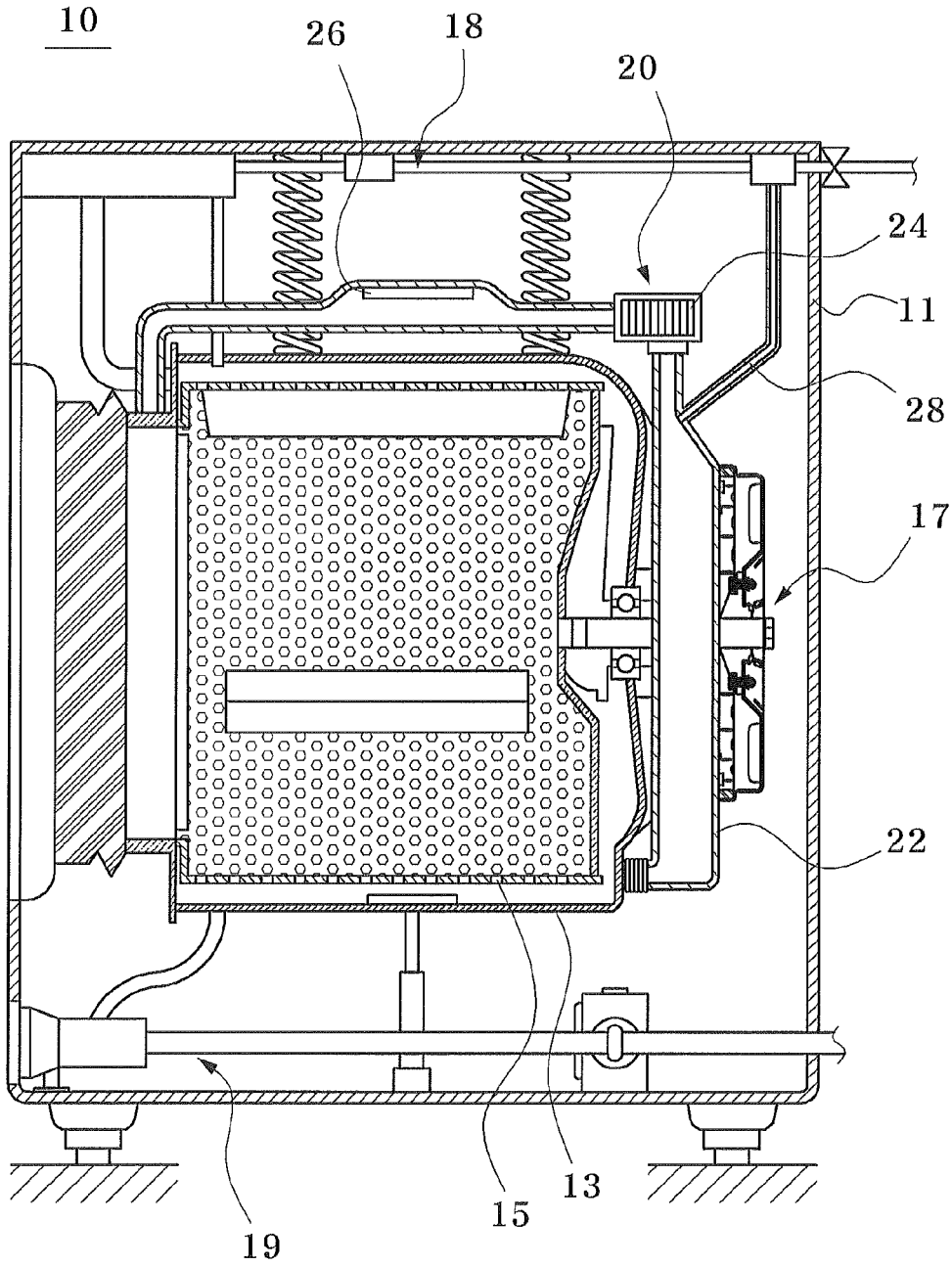
Fig. 1 Prior Art
FIG. 1 is a sectional view of a conventional drum washing machine.
Figure 2:
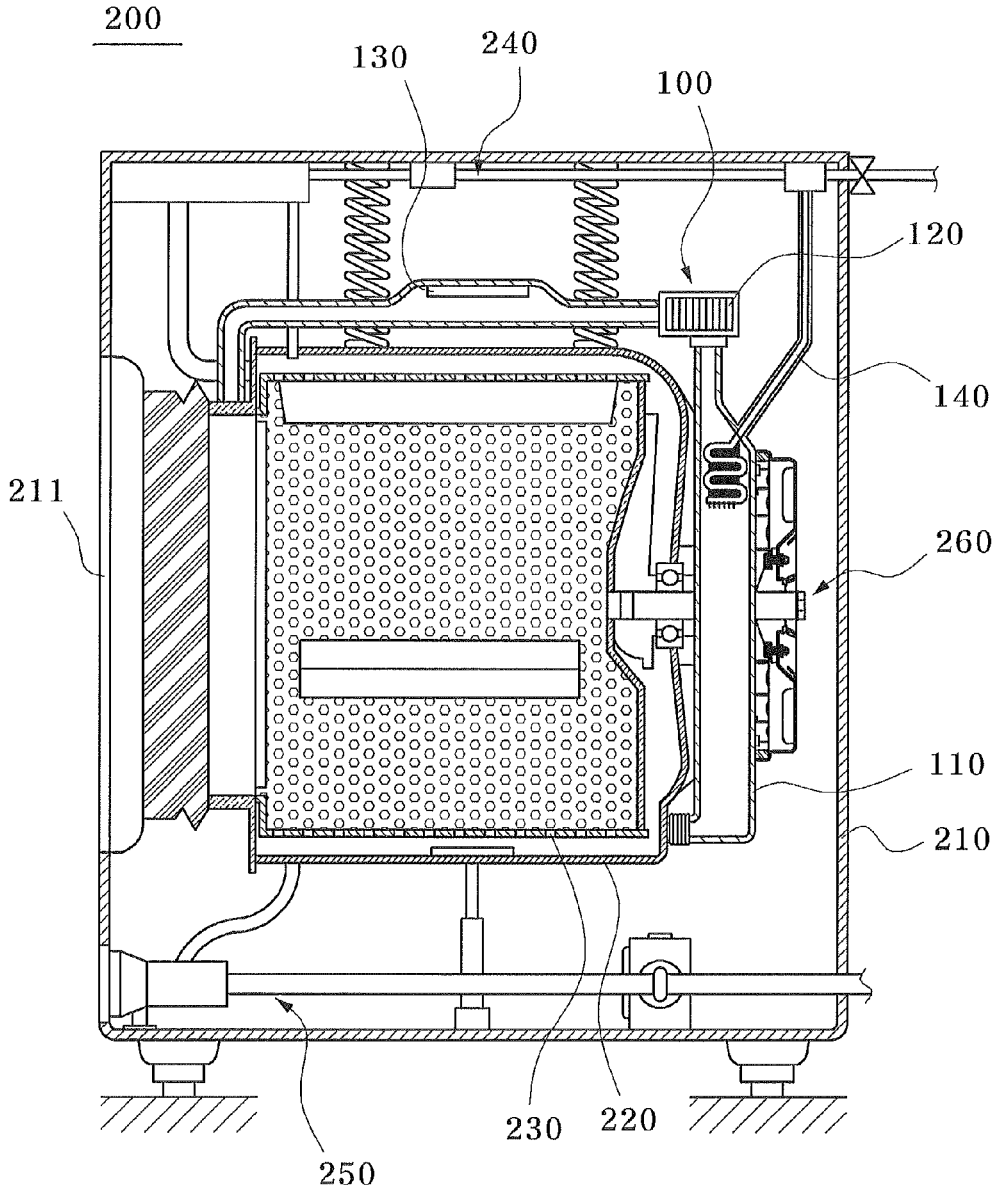
FIG. 2 is a sectional view of a washing machine including a condensation type dryer according to one embodiment of the present invention.
Figure 3:
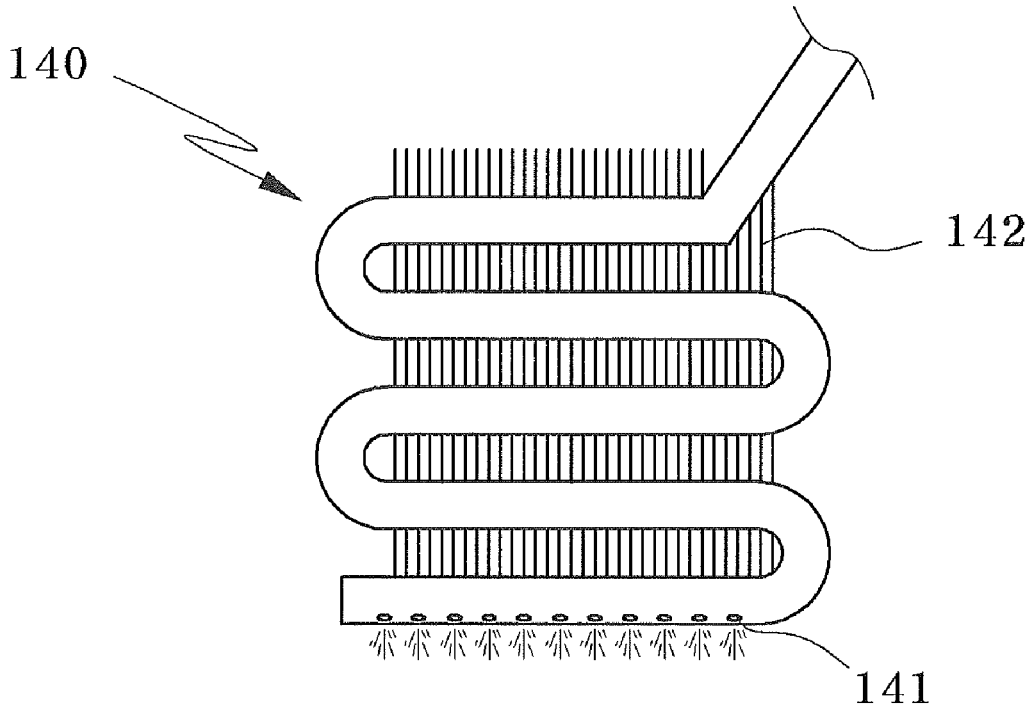
FIG. 3 is a view of a condensation tube according to one embodiment of the present invention.
Figure 4:
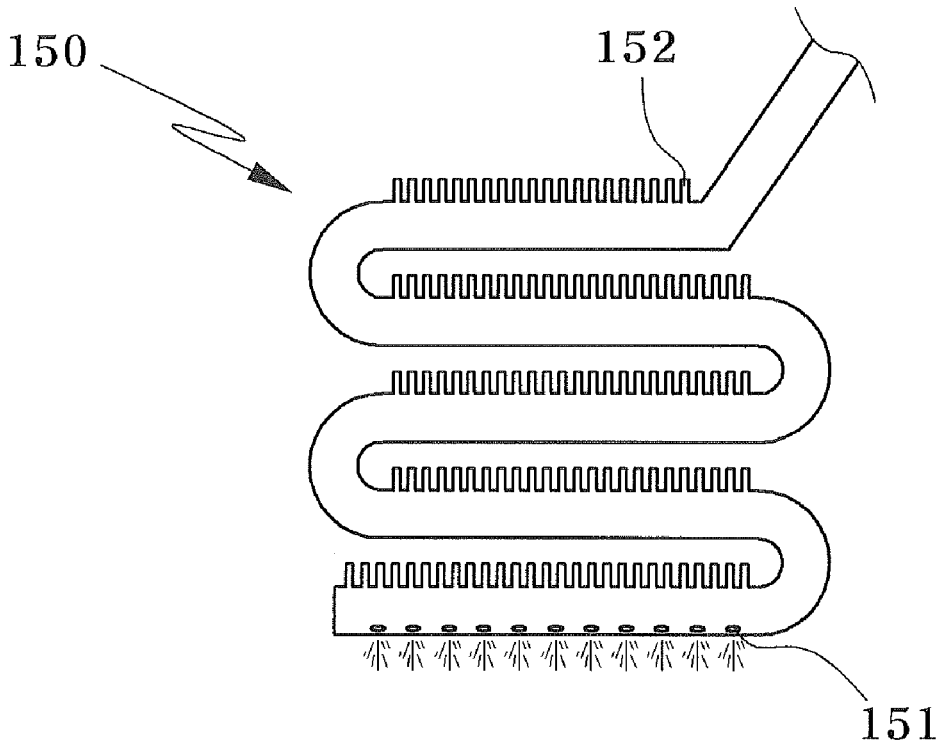
FIG. 4 is a view of a condensation tube according to another embodiment of the present invention.

FIG. 2 is a sectional view of a washing machine including a condensation type dryer according to one embodiment of the present invention, FIG. 3 is a view of a condensation tube according to one embodiment of the present invention, and FIG. 4 is a view of a condensation tube according to another embodiment of the present invention.

A condensation type dryer 100 according to one embodiment of the invention condenses hot air containing moisture with cooling water, and may be applied to any dryer or washing machine which can utilize condensation of hot air. In this embodiment, a drum washing machine 200 will be illustrated as one example to which the dryer according to present invention is applied.

Referring to FIG. 2, the washing machine 200 includes a cabinet 210 which constitutes an outer appearance and is formed at one side thereof with an opening to be opened or closed by a door 211 mounted to the cabinet 210.

Further, the washing machine 200 includes a tub 220 disposed inside the cabinet 210 to receive wash water, and a drum 230 rotatably disposed inside the tub 220 to receive laundry. The tub 220 is provided with a drive unit 260, which is connected to the drum 230 to rotate the drum 230.

A water supply part 240 is connected to a water supply source outside the cabinet 210 to supply wash water into the tub 220, and a drainage part 250 communicates with the tub 220 to discharge the wash water from the tub 220 to the outside.

The tub 220 is provided with a condensation type dryer 100, which includes a circulation tube 110, a blowing fan 120, a heater 130, and a condensation tube 140.

The circulation tube 110 communicates at both ends thereof with the tub 220 to serves as a passage through which air inside the tub 220 circulates. Specifically, the circulation tube 110 communicates at one end thereof with a rear side lower end of the tub 220 and extends upward and frontward therefrom to communicate at the other end thereof with a front side upper end of the tub 220. The front side upper end of the tub 220 may be an upper end above the opening of the tub 220.

The blowing fan 120 is located inside the circulation tube 110 to circulate air inside the tub 220 through the circulation tube 110. In other words, the air inside the tub 220 is introduced into the circulation tube 110 and is supplied again into the tub 220 after circulating through the circulation tube 110 by the blowing fan 120.

The heater 130 is disposed inside the circulation tube 110 to heat the air introduced into the circulation tube 110, and the air heated into a high temperature/dry state is supplied into the tub 220 by the blowing fan 120.

As such, air discharged from the tub 220 to the circulation tube 110 is changed into the high temperature/dry state by the heater 130 while flowing along the circulation tube 110, and is then supplied again into the tub 220.

The condensation tube 140 is connected to a water supply source (not shown) outside the cabinet 210 or to a water supply part 240 to supply cooling water into the circulation tube 110. A portion of the condensation tube 140 disposed inside the circulation tube 110 has a serpentine shape, which increases a contact area between airflow in the circulation tube 110 and the cooling water supplied thereto. In particular, since the serpentine shape of the condensation pipe 140 is formed in the vertical direction, the contact area between air circulating in the circulation tube 110 and the cooling water flowing across the condensation tube 140 can be further increased. An increase in contact area between the airflow in the circulation tube 140 and the cooling water results in enhancement of condensation performance and drying efficiency.

Referring to FIG. 3, according to one embodiment of the invention, the condensation tube 140 is provided with one or more nozzles 141 which spray the cooling water. The nozzles 141 are provided to a lower end of the condensation tube 140, specifically, to a portion of the condensation tube 140 where the condensation tube 140 initially contacts the airflow inside the circulation tube 110. The plural nozzles 141 may be arranged at predetermined intervals to uniformly spray the cooling water.

The condensation tube 140 is provided with cooling fins 142 that prevent the cooling water sprayed through the nozzles 141 from scattering. The cooling fins 142 are arranged parallel to an airflow direction in the circulation tube 110 to prevent the airflow from being obstructed by the cooling fins 142 inside the circulation tube 110. The cooling fins 142 are made of a material having good thermal conductivity and are arranged at predetermined intervals.

Referring to FIG. 4, a condensation tube 150 according to another embodiment of the invention is provided with one or more nozzles 151 that spray the cooling water. Further, the condensation tube 150 is formed with extensions 152 that communicate with the condensation tube 150 and prevent the cooling water sprayed through the nozzles 151 from scattering. With this configuration, the cooling water in the condensation tube 150 can be supplied into the extensions 152 and air inside the circulation tube 110 contacts the extensions 152, which are decreased in temperature by the cooling water supplied thereto, thereby enhancing condensation performance. The extensions 152 extend from an outer peripheral surface of the condensation tube 150 and are arranged parallel to the airflow direction in the circulation tube 110 so as not to prevent the airflow from being obstructed by the extensions 152.

Next, operation of the condensation type dryer and the washing machine including the same according to the embodiments of the present invention will be described.

When a washing cycle of the washing machine 200 is started with laundry received in the drum 230, wash water is supplied into the tub 220 through the water supply part 240 and the drum 230 is rotated by the drive unit 260.

After completing the washing cycle and a spinning cycle, a drying cycle is started. Then, the blowing fan 120 is operated to allow air circulation by introducing air inside the tub 220 into the circulation tube 110.

Air circulating in the circulation tube 110 is heated and changed into a high temperature/dry state by the heater 130 and is then supplied again into the tub 220. The air supplied into the tub 220 dries the laundry inside the tub 220 and is discharged to the circulation tube 110.

High temperature/humidity air introduced into the circulation tube 110 is condensed and changed into a low temperature/dry state via contact with the cooling water sprayed through the nozzles 141 or 151. Then, the low temperature/dry air is heated by the heater 130 while being supplied into the tub 220 by the blowing fan 120.

Since the condensation tube 140 or 150 has a serpentine shape, the contact area between airflow in the circulation tube 110 and the surface of the condensation tube 140 or 150 is increased, thereby enhancing condensation performance. Further, since the cooling water is finely and uniformly sprayed by the nozzles 141 or 151 provided to the lower end of the condensation tube 140 or 150, the condensation performance of the airflow in the circulation tube 110 is enhanced, thereby also enhancing drying efficiency.

The condensation tube 140 or 150 is provided with the cooling fins 142 or the extensions 152 to increase the contact area between high temperature/humidity air and the condensation tube 140 or 150, thereby further enhancing the condensation performance. Further, the cooling fins 142 or the extensions 152 can prevent scattering of the cooling water which is sprayed by the nozzles 141 or 151, thereby preventing the cooling water from being introduced into the blowing fan 120.

As apparent from the above description, according to one embodiment of the present invention, the condensation type dryer has an enlarged contact area between air circulating in a circulation tube and cooling water supplied into the circulation tube, thereby enhancing condensation performance and drying efficiency.

Further, the condensation type dryer can reduce a consumption amount of the cooling water and energy consumption by shortening a drying cycle.

Moreover, the condensation type dryer can prevent the cooling water from flowing into the blowing fan by preventing scattering of the cooling water.

Although some embodiments have been provided to illustrate the present invention in conjunction with the accompanying drawings, it will be apparent to those skilled in the art that the embodiments are given by way of illustration only, and that various modifications and equivalent embodiments can be made without departing from the spirit and scope of the present invention. Accordingly, the scope and spirit of the present invention should be limited only by the following claims.

What is claimed is:

1. A condensing-type drying apparatus comprising:

a circulation tube communicating at both ends thereof with a tub to define a passage through which air inside the tub is circulated;

a blowing fan disposed inside the circulation tube to circulate the air inside the tub;

a heater disposed inside the circulation tube to heat air supplied into the tub; and a condensation tube connected to a water supply source to supply cooling water into the circulation tube, the condensation tube having a serpentine shape, wherein the circulation tube communicates at one end thereof with a rear side lower end of the tub and extends upward and frontward from the rear side lower end of the tub to communicate at the other end thereof with a front side upper end of the tub;

wherein the condensation tube has the serpentine shape in a vertical direction to enlarge a contact area with air circulating in the circulation tube;

wherein the condensation tube is provided with a plurality of cooling fins which prevent the cooling water from scattering.

2. The condensing-type drying apparatus according to claim 1, wherein the condensation tube is provided with a nozzle which sprays the cooling water.

3. The condensing-type drying apparatus according to claim 2, wherein the nozzle comprises a plurality of nozzles arranged at predetermined intervals on a lower end of the condensation tube.

4. The condensing-type drying apparatus according to claim 1, wherein the plurality of cooling fins are arranged parallel to an airflow direction in the circulation tube.

5. The condensing-type drying apparatus according to claim 2, wherein the condensation tube is formed with an extension part which communicates with the condensation tube and prevents the cooling water from scattering.

6. The condensing-type drying apparatus according to claim 5, wherein the extension part extends from an outer peripheral surface of the condensation tube to be parallel to an airflow direction in the circulation tube.

* * * * *